US010074945B2

(12) United States Patent
Polinski

(10) Patent No.: US 10,074,945 B2
(45) Date of Patent: Sep. 11, 2018

(54) MULTI-CONTACT CONNECTOR FOR AN AUDIO JACK ASSEMBLY

(71) Applicant: David Polinski, Stuart, FL (US)

(72) Inventor: David Polinski, Stuart, FL (US)

( * ) Notice: Subject to any disclaimer, the term of this patent is extended or adjusted under 35 U.S.C. 154(b) by 0 days.

(21) Appl. No.: 15/707,389

(22) Filed: Sep. 18, 2017

(65) Prior Publication Data

US 2018/0076580 A1 Mar. 15, 2018

Related U.S. Application Data

(63) Continuation-in-part of application No. 15/263,937, filed on Sep. 13, 2016, now Pat. No. 9,812,824.

(51) Int. Cl.

| | |
|---|---|
| ***H01R 24/58*** | (2011.01) |
| ***H01R 24/38*** | (2011.01) |
| ***H01R 13/502*** | (2006.01) |
| *H01R 107/00* | (2006.01) |
| *H01R 103/00* | (2006.01) |
| *H01R 105/00* | (2006.01) |
| *H01R 13/11* | (2006.01) |

(52) U.S. Cl.

CPC ..... *H01R 24/38* (2013.01); *H01R 13/502* (2013.01); *H01R 24/58* (2013.01); *H01R 13/111* (2013.01); *H01R 2103/00* (2013.01); *H01R 2105/00* (2013.01); *H01R 2107/00* (2013.01)

(58) Field of Classification Search

CPC ..... H01R 2105/00; H01R 2107/00; H01R 13/111; H01R 13/40; H01R 13/746; H01R 24/58; H01R 24/60

USPC ..... 439/668, 669, 265, 856, 857, 656, 723, 439/381

See application file for complete search history.

(56) References Cited

U.S. PATENT DOCUMENTS

| | | | | |
|---|---|---|---|---|
| 4,275,946 | A | 6/1981 | Manina et al. | |
| 6,220,899 | B1 | 4/2001 | Suzuki | |
| 6,270,380 | B1 | 8/2001 | Shichida et al. | |
| 6,390,856 | B1 | 5/2002 | D'Addario et al. | |
| 6,533,617 | B1 | 3/2003 | D'Addario | |
| 6,923,687 | B2 | 8/2005 | Wang | |
| D607,834 | S | 1/2010 | Huang | |
| 7,654,872 | B2 | 2/2010 | Lin et al. | |
| 7,785,119 | B1 | 8/2010 | Chiang | |
| 7,794,285 | B1 | 9/2010 | Huang | |
| 7,874,855 | B1 | 1/2011 | Ye et al. | |
| 7,950,966 | B1 | 5/2011 | Chen et al. | |
| 7,967,643 | B1 | 6/2011 | D'Addario et al. | |
| 7,988,498 | B1 | 8/2011 | Lim et al. | |
| 8,801,476 | B2 | 8/2014 | Zhang | |
| 8,888,537 | B2 | 11/2014 | Do | |
| 9,583,898 | B2 | 2/2017 | DeCola | |
| 9,680,264 | B2 | 6/2017 | Polinski | |
| 9,812,824 | B1 * | 11/2017 | Polinski | H01R 24/58 |
| 2006/0014426 | A1 * | 1/2006 | Montena | H01R 9/0524 439/578 |

(Continued)

*Primary Examiner* — Chandrika Prasad

(74) *Attorney, Agent, or Firm* — McHale & Slavin, P.A.

(57) ABSTRACT

Disclosed is an audio barrel jack assembly that reduces or eliminates signal loss when used with either a mono or stereo audio plug. The jack assembly employs a support housing having a passageway sized to receive a conventional audio plug. The passageway including connectors that engage opposite sides of the audio jack for increased surface engagement providing an improved electrical connection.

13 Claims, 10 Drawing Sheets

(56) References Cited

U.S. PATENT DOCUMENTS

| | | | | |
|---|---|---|---|---|
| 2006/0246783 | A1* | 11/2006 | Ho | H01R 13/508 439/669 |
| 2007/0232150 | A1 | 10/2007 | Lee | |
| 2009/0149080 | A1 | 6/2009 | Wu | |
| 2009/0298347 | A1 | 12/2009 | Wu et al. | |
| 2014/0073161 | A1* | 3/2014 | Winningham | H01R 13/521 439/271 |
| 2016/0190753 | A1 | 6/2016 | DeCola | |
| 2017/0093098 | A1 | 3/2017 | Polinski | |

* cited by examiner

MULTI-CONTACT CONNECTOR FOR AN AUDIO JACK ASSEMBLY

RELATED APPLICATION

In accordance with 37 C.F.R. § 1.76, a claim of priority is included in an Application Data Sheet filed concurrently herewith. Accordingly, the present invention claims priority as a continuation-in-part of U.S. patent application Ser. No. 15/263,937, filed Sep. 13, 2016, entitled MULTI-CONTACT AUDIO JACK CONNECTOR ASSEMBLY, the contents of which are incorporated herein by reference.

FIELD OF THE INVENTION

This invention relates to the field of connectors used for audio signals; and in particular, to an improved audio barrel jack connector assembly for use with either stereo or mono signals.

BACKGROUND OF THE INVENTION

Audio jacks, also referred to as jack plugs, are commonly used in connector assemblies for carrying audio signals. Dating back to the late 1800's, the audio jack is one of the oldest electrical standards still in existence. The audio jack is the preferred connector for use in the music industry based upon a 6.35 mm (¼ inch) plug diameter, which provides a robust assembly that can be reused indefinitely. However, the audio jack receptacle is subject to misalignment and wear.

The size of the audio jack makes it easy to grasp without tools, and it cannot be bent if stepped upon or otherwise used in a manner expected of insertion and removal. For this reason, the audio jack is the preferred connector for use with electric guitars, microphones, speakers, amplifiers, line levelers and like equipment found in the music industry, primarily audio signal transmission. The audio jack is cylindrical in shape having two, three or four contacts.

Unique to the audio jack is the amount of surface area that is provided by a cylindrical plug. However, the connector to which the plug engages is typically a single prong having a single point of contact. The single point of contact can become problematic, as it needs to press against the plug in order to create a connection. The greater force the contact imparts upon the plug, the better the electrical connection; however, the higher stress placed upon the connector can cause the ground connector to be off center and lose contact. If the electrical contact is slight, the ability to transfer an electrical signal is reduced and the signal can be compromised. The conventional electrical contacts employed to engage the audio plug provide very little contact surface, which results in poor audio quality.

Numerous attempts have been made to improve upon the audio jack. U.S. Pat. No. 7,874,855 describes an audio jack connector having an insulating housing and a passageway. A contacting terminal is disposed on a side of the passageway having a holding portion and two contacting pieces slanted toward the same side separately from two opposite ends of the holding portion. A first fixing terminal, arranged on a side of the passageway, adjacent to the contacting terminal, has a first fixing slice. The first fixing slice has a side extended obliquely to form a first contacting piece connecting with one contacting piece. A second fixing terminal placed on an opposite side of the passageway has a second fixing slice, a second contacting piece obliquely connected with the second fixing slice for connecting with the other contacting piece. The contacting pieces are forced to slide on and depart from the first contacting piece and the second contacting piece when the contacting terminal is elastically pushed by the inserted plug.

U.S. Publication No. 2007/0232150 describes an audio jack connector including a housing and a set of contacts. The housing has a body, a mating portion extending from one end of the body, and an insertion hole defined in the mating portion and extending inwardly through the body along an axis direction. The set of contacts include signal contacts, a set of switching contacts disposed in the housing, and an exposed contact disposed at the outside of the housing. The switching contacts have a fixed contact and a movable contact. The mating portion of the housing has a cavity defined at an outer surface thereof for receiving a contacting portion of the exposed contact. The contacting portion has a propping block protruding outwardly beyond the outer surface of the mating portion.

U.S. Publication No. 2009/0298347 describes an audio jack connector that is suitable for selectively engaging with either a first multi-pole plug or a second multi-pole plug having more poles than the first multi-pole plug. Each of the multi-pole plugs has a plurality of poles insulated by insulating rings arranged thereinbetween. The audio jack connector includes an insulating housing having a chamber extending inward from a front thereof, and terminal groups. The terminal groups are disposed in the corresponding grooves and project into the chamber. When either of the first and the second multi-pole plugs is respectively inserted into the chamber, the terminal groups are against the multi-pole plug, wherein at least one of the terminal groups is against one of the insulating rings of the first multi-pole plug.

U.S. Pat. No. 6,220,899 discloses a connecting sleeve spring resiliently mounted in a connecting sleeve of an electrical connecting jack. The connecting sleeve spring has an arcuate sinusoid-like side profile, with its two ends curving in a direction opposite the curve of a center contact portion. The center portion has an inwardly angled tongue. When a plug having a collar is inserted into the electrical connecting jack, the collar comes in contact with the tongue and pushes the central contact portion inward, thus forcing the two ends of the connecting sleeve spring to move outward. The two ends press against the inner periphery of the collar.

U.S. Pat. No. 6,270,380 discloses a multipolar electrical connector that, as a counter connector, uses a single-head plug having a pole shaft in which center poles are disposed in plural positions in the axial direction, respectively (hereinafter, referred to merely as "multipolar connector"). In the invention, plural predetermined contact pieces are incorporated into the body, so that plural poles are ensured by the predetermined contact pieces. A required number of first additional contact pieces and second additional contact pieces are placed on the outer and inner peripheral sides of the boss portion, so that two or more poles are ensured by the additional contact pieces. According to the invention, therefore, the number of poles is increased by that of poles which are formed by the additional contact pieces.

U.S. Pat. No. 6,923,687 discloses an audio jack connector comprising a rectangular-shaped insulating housing, and a plurality of different contacts. The insulative housing has a base and a mating portion. A channel extends through the base and the mating portion. A front end of the channel defines a gap, and a number of receiving slits defined on the base at two sides of the channel, the base defining a depression communicating with the channel at a top wall thereof. A first and a second contact are received in the slits. A third contact mates with the top wall and comprises a mounting portion extending beyond the bottom wall of the insulative housing. A fourth contact is installed in a front end of the insulative housing and has an engaging portion extending through the gap and inserted into the front end of the channel for electrically connecting the mating plug connector.

U.S. Pat. No. 7,654,872 discloses an audio jack connector which includes a housing and a terminal group. The housing has an insertion hole extending inward from the front of the housing. The bottom of the base defines at least one signal terminal recess and an auxiliary terminal recess, a first aperture is defined in the bottom of the auxiliary terminal recess and communicates with the signal terminal recess. The terminal group has at least one signal terminal and an auxiliary terminal received in the signal terminal recess and the auxiliary terminal recess respectively. The signal terminal has a contact portion projecting into the insertion hole and an elastic portion extending from the end of the contact portion.

U.S. Pat. No. 7,785,119 discloses an audio jack connector having an insulating housing defining a rectangular base. The base has a passageway passing therethrough for receiving an inserted audio plug connector. A channel is formed at a top surface of the base for communicating with the passageway. A set of switch terminals mounted to the insulating housing comprise an elastic terminal and a fixing terminal. The elastic terminal has a first top plate and a switch arm extended outward from the first top plate, with a free end thereof projecting into the passageway through the channel. The fixing terminal has a second top plate disposed above the channel. The second top plate has a pair of cantilever switch slices extending toward each other and perpendicular to an extending direction of the switch arm, with free ends thereof suspended over the free end of the switch arm and spaced from each other.

U.S. Pat. No. 7,794,285 discloses an audio jack connector for receiving an audio plug connector which includes an insulating housing and a contact terminal. The insulating housing defines an insertion hole from a front end to a rear end thereof for receiving the audio plug connector and a recess communicating with the insertion hole. The contact terminal has a connecting portion received in the recess. Two opposite ends of the connecting portion are extended toward a same side to form a base portion and a first elastic arm. A first contact portion is protruded towards the base portion from a free end of the first elastic arm. A second elastic arm is bent towards the connecting portion from one end of the base portion. A second contact portion is protruded towards the first elastic arm from a free end of the second elastic arm. The first and second contact portions protrude into the insertion hole.

U.S. Pat. No. 8,801,476 discloses an electrical contact of an audio jack connector including a main portion, a soldering portion bending from a lateral edge of the main portion, an elastic portion extending curvedly from a distal end of the main portion to be located above the main portion. The elastic portion has a flexible beam, a first arm extending upwardly from the flexible beam and a second arm curvedly bending from the first arm. The first arm is consistent with a direction along which an audio plug connector is inserted. The second arm is adverse to a direction along which the audio plug connector is withdrawn.

U.S. Pat. No. 8,888,537 discloses an improved electronic audio receptacle connector which employs contacts that have multiple points of contact with a mating audio plug. The contacts each have multiple segments, each segment having a plurality of transverse fingers that interface with a conductive portion of the audio plug. The multiple points of contact improve the reliability of the receptacle connector. The housing of the receptacle connector may be made of two portions mated along an interface. The two portions may have features along the interface to impede moisture ingression and to interlock them together. U.S. Pat. No. D607,834 discloses an ornamental design for a contact of an audio plug connector.

Applicant's U.S. Pat. No. 9,680,264 discloses an audio jack assembly that reduces or eliminates signal loss with an audio jack by use of a support housing having a passageway sized to receive the audio plug with an insulated first connector having first and second terminal strips. Each of the terminal strips are formed integral to a first disk base and positioned to engage the grooved tip of an audio plug when engaged. A second isolated connector includes first and second terminal strips positioned to engage each side of a sleeve when the audio plug is engaged. The second connector is electrically isolated from the first connector, wherein the second connector is fastened to the support housing, securing the first connector therebetween.

SUMMARY OF THE INVENTION

Disclosed is an audio barrel jack assembly for receiving a conventional audio plug comprising a support housing having a passageway sized to receive the audio plug. Biasing terminals are positioned within the support housing to permit either an improved mono or stereo connection.

An objective of the invention is to provide an audio barrel jack assembly for use with either stereo or mono signals that reduces or eliminates signal loss between the jack receptacle and a conventional audio plug.

Another objective of the invention is to provide an audio barrel jack assembly that employs connectors formed integral with a common base to provide a uniform clamp pressure on the sleeve and grooved tip of an audio plug.

Still another objective of the invention is to provide an audio barrel jack assembly having scalloped terminals for engaging a larger surface area of an audio plug to assure a resistance free connection.

Yet still another objective of the invention is to provide an audio barrel jack assembly having terminals that are maintained in position by a notched insulator ring.

Yet still another objective of the invention is to provide an audio jack assembly design that can be scaled from ¼ inch, ⅛ inch, and micro sizes.

Another objective of the invention is to provide an audio jack assembly design that can be used with cell phone, television, computers and many other consumer electronics that would benefit from good electrical contact.

Other objectives and further advantages and benefits associated with this invention will be apparent to those skilled in the art from the description, examples and claims which follow.

DETAILED DESCRIPTION OF THE PREFERRED EMBODIMENT

Figure 1:
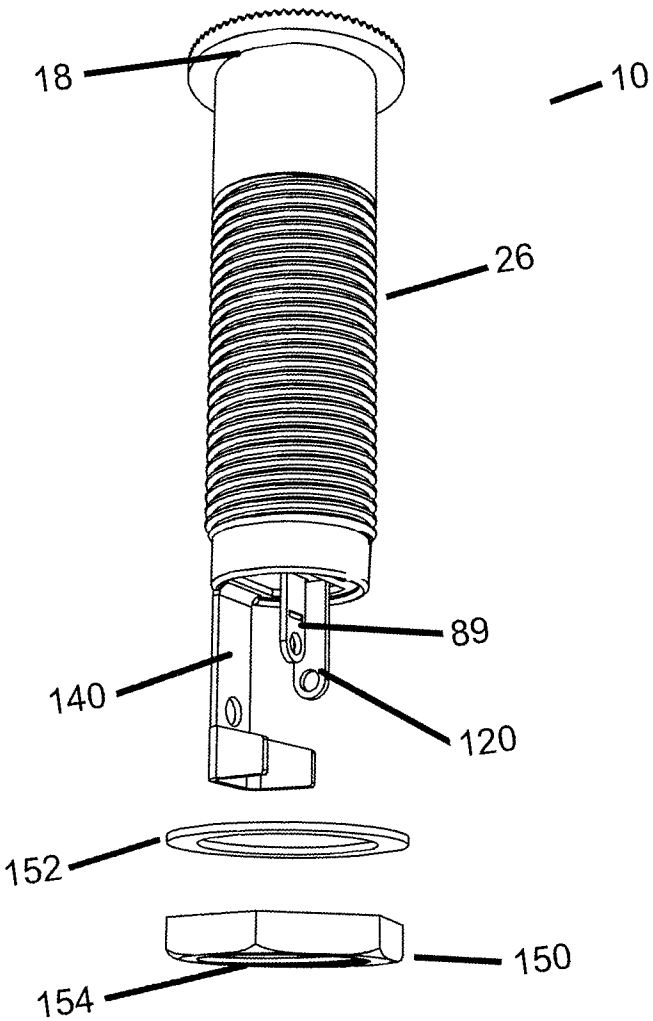
FIG. 1 is a perspective view of the audio barrel jack assembly.
Figure 2:
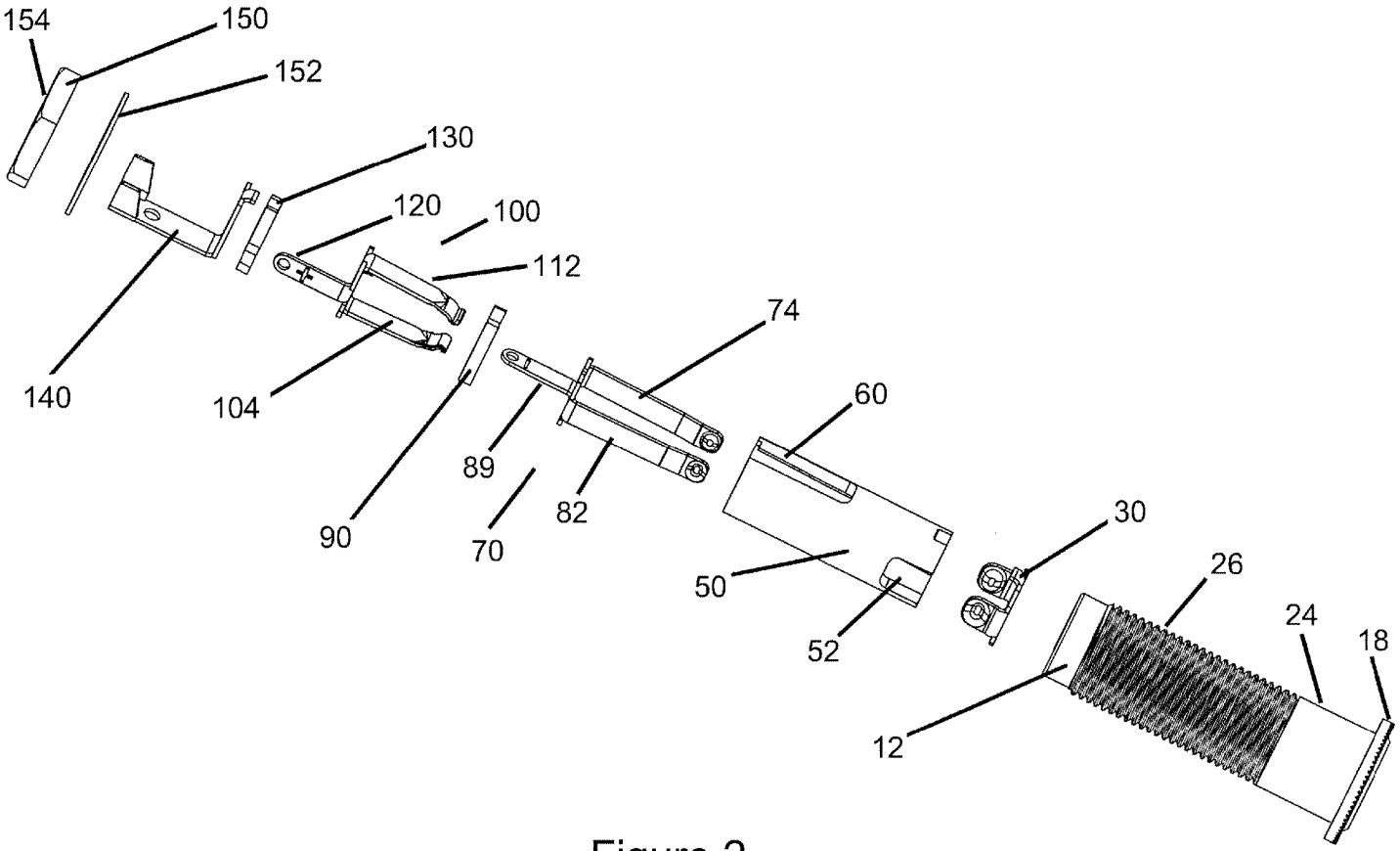
FIG. 2 is an exploded view thereof.
Figure 3:
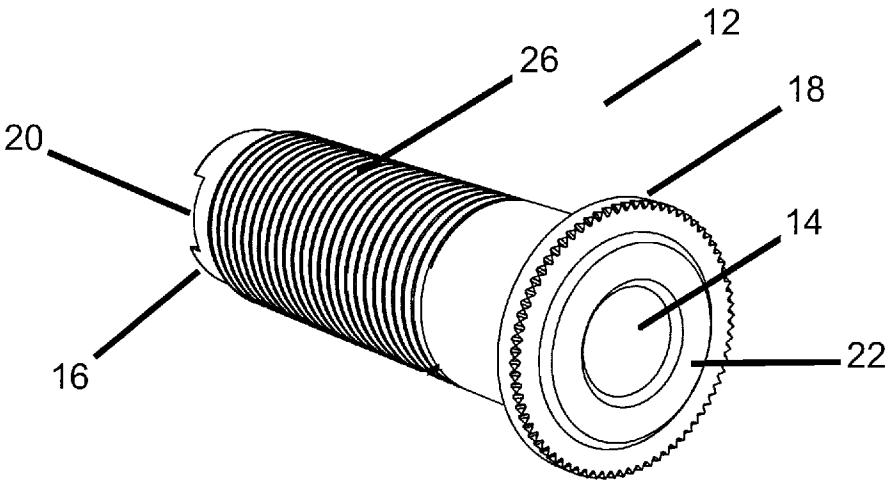
FIG. 3 is a perspective view of the barrel.
Figure 4:
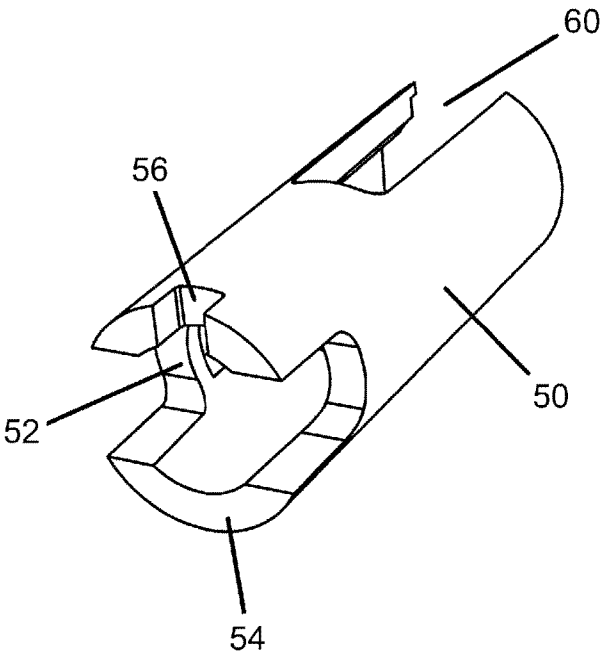
FIG. 4 is a front perspective view of the sleeve.
Figure 5:
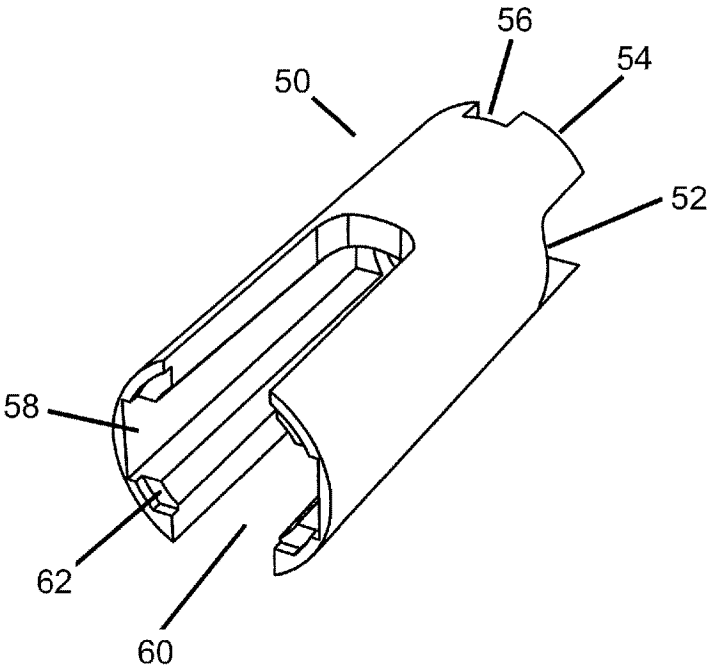
FIG. 5 is a rear perspective view of the sleeve.
Figure 6:
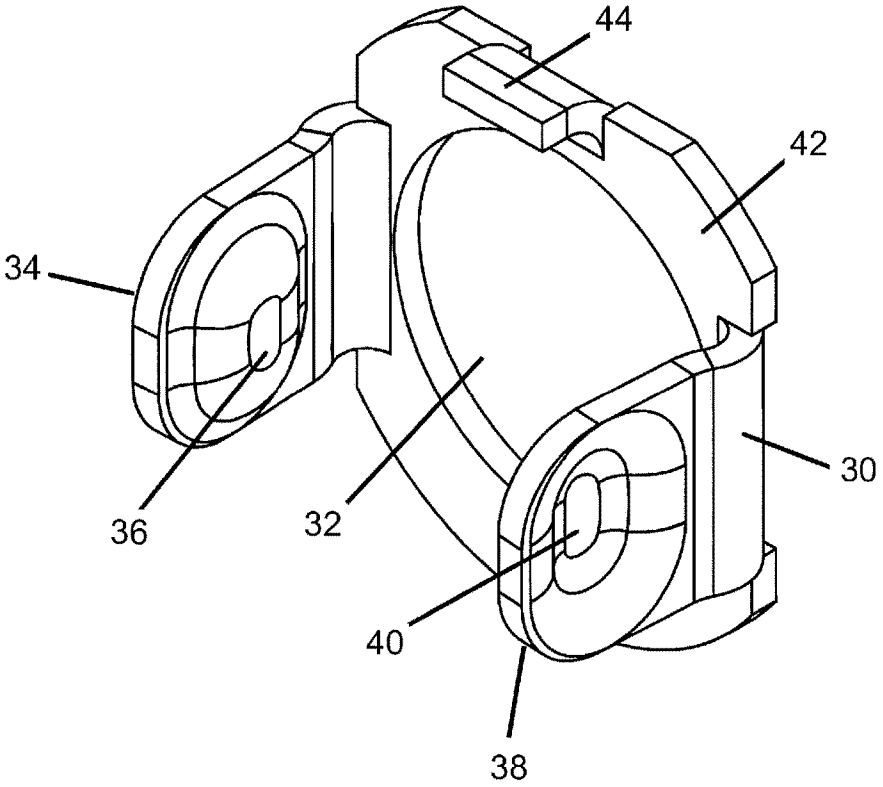
FIG. 6 is a perspective view of the ground contact.
Figure 7:
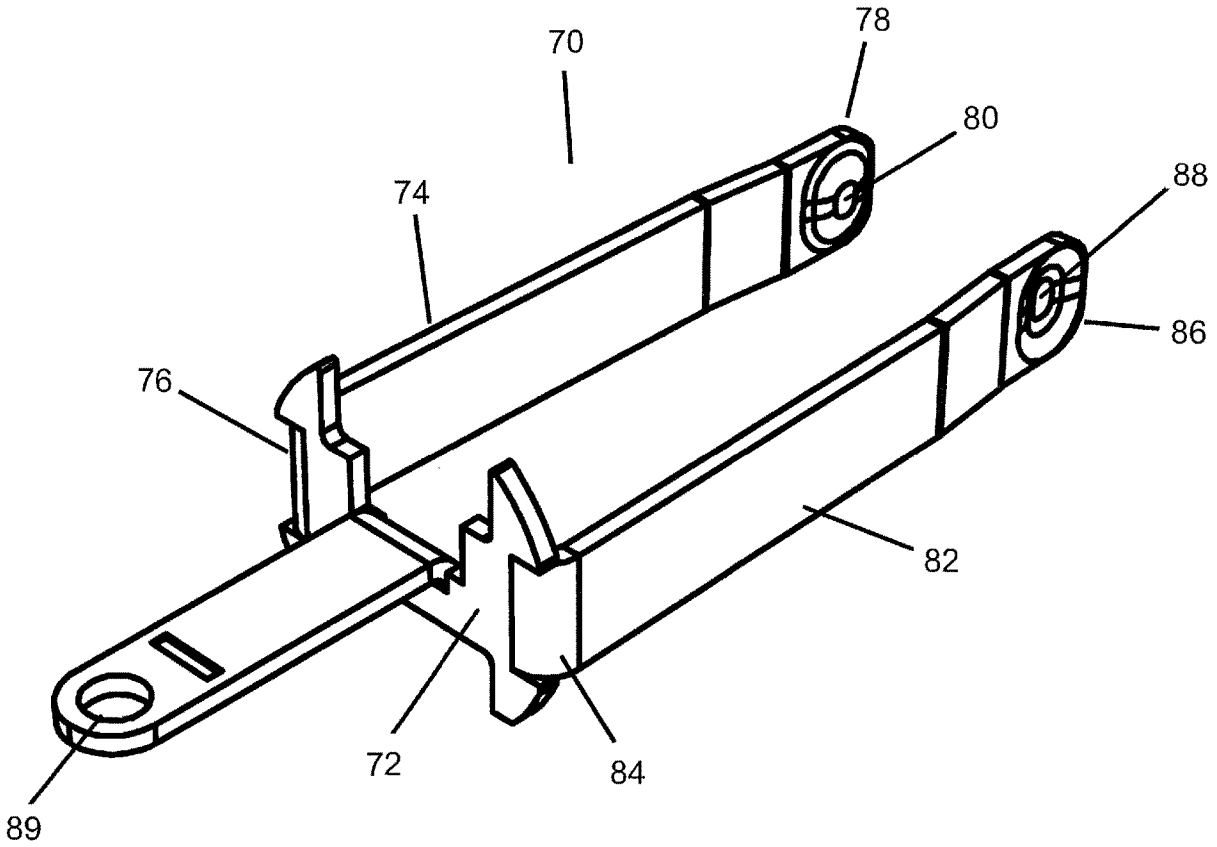
FIG. 7 is a perspective view of the negative connector.
Figure 8:
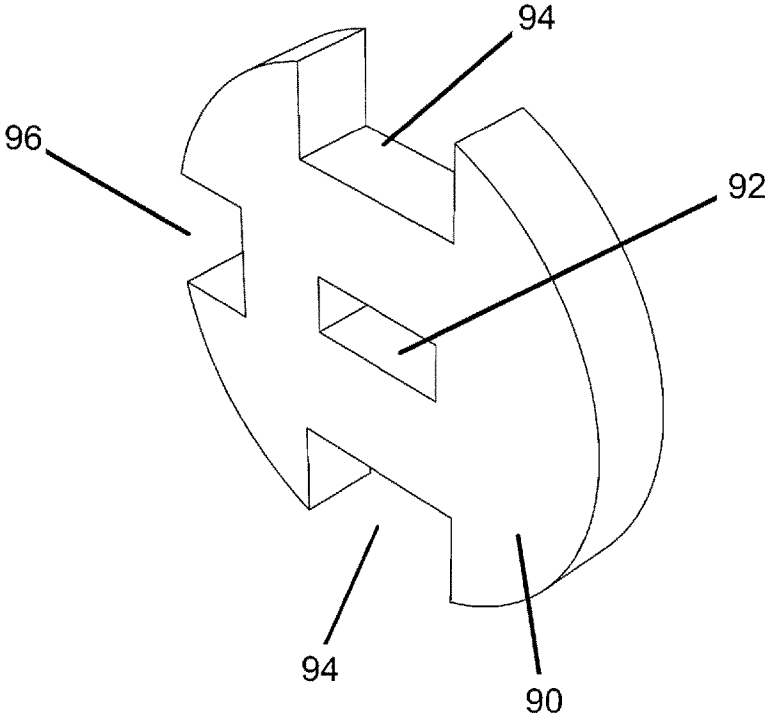
FIG. 8 is a perspective view of the first spacer.
Figure 9:
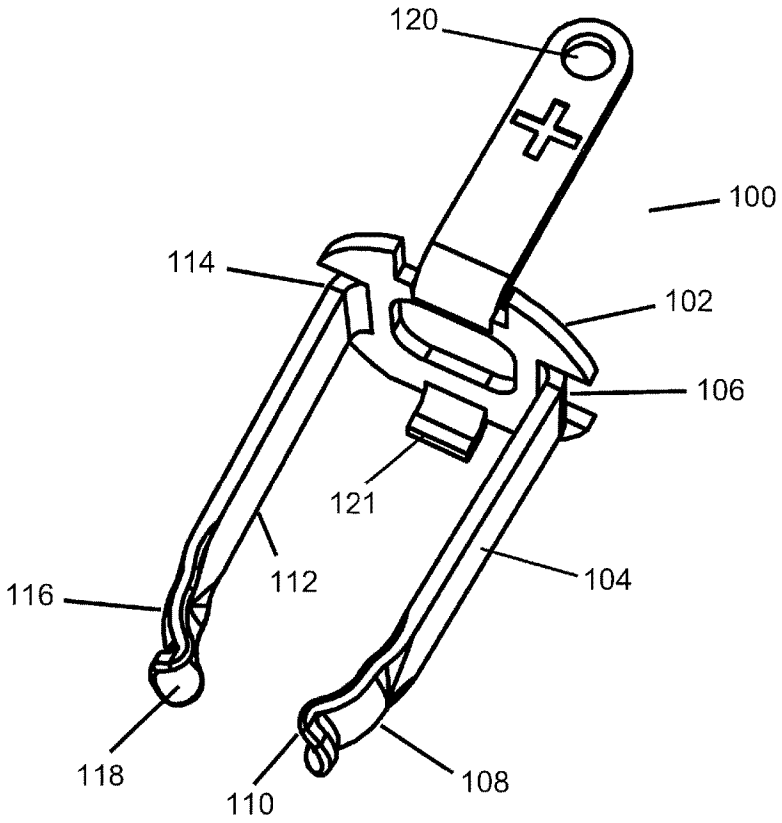
FIG. 9 is a perspective view of the positive connector.
Figure 10:
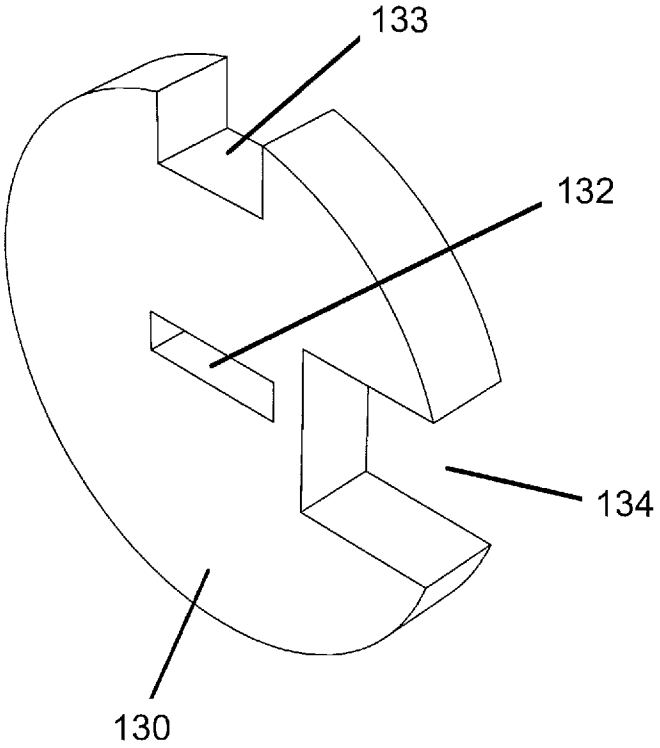
FIG. 10 is a perspective view of the second spacer.
Figure 11:
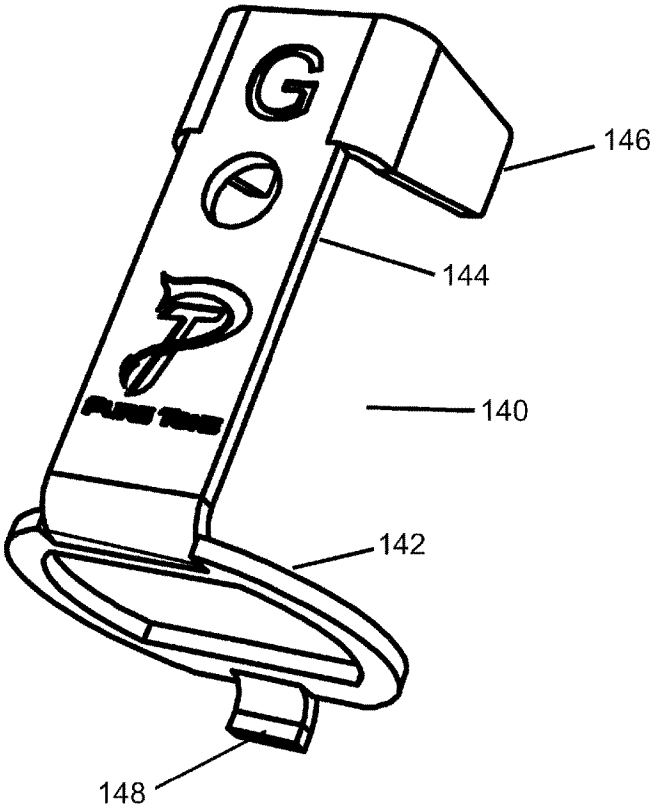
FIG. 11 is a front end perspective view of the ground terminal.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to the drawings, set forth is an audio barrel jack assembly 10 for receiving a conventional audio plug. The preferred audio plug is a conventional 6.35 mm (¼ inch) plug that has been an industry standard for over a century. The conventional audio plug, not shown, includes a groove formed along a tip, which operates as a detent and is commonly used for securing the audio plug into a receiving jack assembly.

The audio barrel jack assembly 10 consists of a support housing 12 having a passageway 14 sized for receipt of an audio plug leading to a larger cavity formed by a continuous sidewall 16 along the rear of the support housing 12. An entry collar 18 is positioned along a frontal end 20 of the support housing. An outer surface 24 of said support housing 12 is threaded 26 for receipt of a fastener nut 150 having reciprocal threads 154 to allow the jack assembly 10 to be mounted to a frame.

A ground contact 30 is insertable into the support housing 12 to engage a portion of the passageway 14 to match continuity between the ground contact 30 and the support housing 12. The ground contact 30 has a centrally disposed aperture 32 and ground contact first terminal 34 having engagement pad 36, and ground contact second terminal 38 having engagement pad 40. The ground contact 30 has a frame 42 from which the first terminal 34 and second terminal 38 are formed perpendicular thereto. A spring like frictional engagement is formed to engage the ground portion of an audio plug, wherein the first and second terminals 34 and 38 engage each side of the audio plug in a uniform application of pressure. Alignment tab 44 is formed to engage a sleeve 50.

Sleeve 50 is made of a non-conductive plastic material, such as nylon, and sized for insertion into the support housing 12. The sleeve 50 is formed from a continuous side wall with end openings 52 along a first end 54 for receipt of the ground contact 30 first terminal 34 and second 38 terminal. The terminals 34 and 38 fit within the end openings which are on each side of the sleeve 50 for engaging the ground portion of the audio plug. An alignment notch 56 receives the ground contact 30 alignment tab 44. The sleeve 50 further includes opposite end framing 58 formed on opposing inner side surfaces of the sleeve 50 for receipt of a first contact connector 70. End openings 60 are formed on opposing side surfaces of the sleeve 50 for receipt of a second contact connector 100. A recess 62 is formed along the end of the sleeve 50.

The first contact connector 70 has a first base 72 supporting a first terminal strip 74 having a proximal end 76 and distal end 78 extending outward therefrom; the distal end having a contact pad 80 extending inwardly. A second terminal strip 82 having a proximal end 84 formed integral with said first base 72 and extending obliquely and symmetrically from an outer edge of the first base 72 to a distal end 86 having an inwardly facing contact pad 88. The contact pads 80 and 88 engage opposite sides of the audio plug. The base 72 of the first contact connector 70 fits within recess 62, and the terminal strips 74 and 82 fit within framing 58 of sleeve 50. A centrally disposed first terminal connector 89 extends outward from the support housing 12.

A first spacer 90 has a central slot for placement over the first terminal contact connector 89. Opposing framing openings 94 align the terminal strips of the second contact connector 100, and alignment notch 96 allows for receipt of an alignment tab from the first terminal contact connector, electrically isolating the contact member from the support housing.

The second contact connector 100 has a second base 102 supporting a third terminal strip 104 having a proximal end 106 formed integral with the second base 102 and extending outward to a distal end 108 having a curved inner body 110 for engaging one side of an audio jack. A forth terminal strip 112 extends symmetrically from a proximal end 114 formed along an outer edge of the second base 102 to a distal end 116 having a curved inner body 118. The third and forth terminal strips 104, 112 are positioned within the support housing 12 to engage a tip portion of the audio plug. An alignment tab 121 extends from said base 102 along an edge thereof, and a second terminal connector 120 extends outwardly from an opposite outer edge of the second base 102.

A second spacer 130 having a central slot 132 for placement over the first contact connector 70 electrically isolates the second contact member 100 from the support housing and from a ground terminal 140. The second spacer 130 includes a first opening 134 for receipt of the second terminal connector 120. Alignment notch 133 is formed for receipt of an alignment tab formed in the ground terminal 140. Spacers 90 and 130 operate as an insulating ring and are preferably constructed from a non-conductive material such as plastic, phenolic, fiber, rubber, cord, paper or the like.

The ground terminal 140 includes a third base 142, which is electrically coupled to the support housing 12 by threading, crimping or weldment. A third terminal 144 extends outwardly from the third base 142 and support housing 12 to crimping arms 146 that can be tightened around cable, housing the wires that make up the electrical connection to the first, second and ground terminals. The ground terminal 140 includes an alignment tab 148 for engaging the central alignment notch 132. The terminals are made of a conductive material, preferably nickel plated copper alloy.

A threaded nut 150 and mounting washer 152 are used to secure the support housing 12 to a frame used to support similar type jacks, wherein the frame is captured between the entry collar 18 and the threaded nut 150.

For ease of clarification, a ¼ inch plug and audio jack assembly has been described as the primary embodiment. However, it is obvious to one skilled in the art, and to be understood, that the audio jack assembly illustrated can be scaled to receive ⅛ inch plug or micro plug sizes using the same terminal configuration. The claims of this invention are not limited to the size of plug and are applicable to ¼ inch, ⅛ inch, or micro plugs.

The term "coupled" is defined as connected, although not necessarily directly, and not necessarily mechanically. All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art, which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. An audio jack assembly for receiving a conventional audio plug comprising:

a support housing having a passageway sized to receive the audio plug;

a ground contact insertable into said support housing and engaging a portion of said passageway to match continuity between the support housing and the ground contact, said ground contact having a centrally disposed aperture and ground contact first and second terminals;

a sleeve insertable into said support housing, said sleeve formed from a continuous side wall with an opening along a first end for receipt of said ground contact first and second terminals, wherein said first and second ground contract terminals are arranged to engage a ground portion of the audio plug;

a first contact connector having a first base supporting first and second terminal strips each having a proximal end formed integral with said first base and extending obliquely and symmetrically from an outer edge of said first base to a distal end, each positioned within said support housing to engage opposite sides of the audio plug, said first contact connector having a centrally disposed first terminal connector extending outward from said support housing;

a first spacer having a central slot for placement over said first terminal contact connector and electrically isolating said first contact member from said support housing;

a second contact connector having a second base supporting third and forth terminal strips each having a proximal end formed integral with said second base and extending obliquely and symmetrically from an outer edge of said second base to a distal end positioned within said support housing to engage a tip portion of the audio plug, a second terminal connector extending outwardly from an outer edge of said second base;

a second spacer having a central slot for placement over said first contact connector and electrically isolating said second contact member from said support housing; and a ground terminal having a third base electrically coupled to said support housing with a third terminal extending outwardly from said support housing.

2. The audio jack assembly according to claim 1 wherein said sleeve includes an alignment notch for maintaining said ground contact in a predetermined axial alignment with said sleeve.

3. The audio jack assembly according to claim 1 wherein said first spacer includes at least one alignment notch for maintaining said second terminal contact in a predetermined axial alignment with first terminal contact connector.

4. The audio jack assembly according to claim 1 wherein said second spacer includes at least one alignment notch for maintaining said ground terminal in a predetermined axial alignment with second terminal contact connector.

5. The audio jack assembly according to claim 1 wherein said sleeve includes an opening constructed and arranged to receive said terminal strips of said second terminal contact connector.

6. The audio jack assembly according to claim 1 wherein said sleeve includes an opening constructed and arranged to receive a portion of said ground terminal to maintain said ground terminal in a predetermined fixed position.

7. The audio jack assembly according to claim 1 wherein said support housing is barrel shaped.

8. The audio jack assembly according to claim 7 wherein said barrel shaped housing includes an entry collar formed along one end and is threaded for receipt of a threaded fastener, wherein said fastener and said entry collar are used to secure said jack assembly to a fixed frame.

9. The audio barrel jack assembly according to claim wherein said first contact connector is constructed and arranged to engage opposite sides of a positive contact portion on the audio jack, said second contact connector is constructed and arranged to engage opposite sides of a negative contact portion on the audio jack.

10. The audio barrel jack assembly according to claim wherein said second contact connector is constructed and arranged to engage opposite sides of a positive contact portion on the audio jack, said first contact connector is constructed and arranged to engage opposite sides of a negative contact portion on the audio jack.

11. The audio barrel jack assembly according to claim wherein said sleeve is constructed from a non-conductive material.

12. The audio barrel jack assembly according to claim 1 wherein said sleeve is plastic.

13. The audio barrel jack assembly according to claim wherein said jack assembly operates with either a mono or digital signal.

* * * * *